US007406276B2

(12) United States Patent
Mimura et al.

(10) Patent No.: US 7,406,276 B2
(45) Date of Patent: Jul. 29, 2008

(54) CONTACT PRESSURE SETTING METHOD AND IMAGE FORMING APPARATUS

(75) Inventors: Takanori Mimura, Tokyo (JP); Junichi Ito, Tokyo (JP); Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 184 days.

(21) Appl. No.: 11/170,355

(22) Filed: Jun. 29, 2005

(65) Prior Publication Data

US 2006/0002741 A1 Jan. 5, 2006

(30) Foreign Application Priority Data

Jun. 30, 2004 (JP) ..... 2004-192502

(51) Int. Cl.
*G03G 15/16* (2006.01)

(52) U.S. Cl. ..... 399/122; 399/126

(58) Field of Classification Search ..... 399/222, 399/126; 492/9
See application file for complete search history.

(56) References Cited

U.S. PATENT DOCUMENTS 6,581,925 B1 * 6/2003 Shea et al. ..... 271/125

FOREIGN PATENT DOCUMENTS

JP 2001-166589 A 6/2001

* cited by examiner

*Primary Examiner*—David M. Gray
*Assistant Examiner*—David A Blackshire
(74) *Attorney, Agent, or Firm*—Panitch Schwarze Belisario & Nadel LLP

(57) ABSTRACT

A contact pressure setting method of setting a contact pressure between contact members of an image forming apparatus. A film member is inserted into a gap between the contact members and the contact pressure is set so that a pulling force to pull out the film member lies within a predetermined range. Thus, the contact pressure can be accurately and easily recognized and the contact pressure can be set to be uniform.

12 Claims, 15 Drawing Sheets

CONTACT PRESSURE SETTING METHOD AND IMAGE FORMING APPARATUS

BACKGROUND OF THE INVENTION

1. Field of the Invention

The invention relates to a contact pressure setting method and an image forming apparatus.

2. Related Background Art

Hitherto, in an image forming apparatus such as an LED (Light Emitting Diode) printer or the like using an electrophotographic system, the surface of a photosensitive body as an electrostatic latent image holding body is charged by a charging apparatus such as a charging roller or the like, the surface of the photosensitive body is exposed by exposing means such as an LED head or the like to thereby form an electrostatic latent image, toner as a developing agent formed as a thin layer on a developing roller as a developing agent holding body is electrostatically adhered to the electrostatic latent image and developed, and the toner is transferred onto a medium such as print paper or the like by a transferring apparatus, thereby forming an image (for example, refer to JP-A-2001-166589). In such an image forming apparatus, since there is a case where the toner which could not be transferred onto the photosensitive body after the transfer remains, the transfer residual toner is removed by a cleaning apparatus.

Although a contact portion of the photosensitive body and the developing roller exists in the image forming apparatus, a contact state of the contact portion is specified by a distance between the axes of the photosensitive body and the developing roller and their contact pressure.

In the conventional image forming apparatus, however, in the case of specifying the contact state of the contact portion of the photosensitive body and the developing roller, although the distance between the axes of the photosensitive body and the developing roller can be measured, the contact pressure of the photosensitive body and the developing roller cannot be directly measured. Therefore, since it is impossible to recognize whether the contact pressure of the photosensitive body and the developing roller is uniform or not with respect to the axial direction of the photosensitive body and the developing roller, the contact pressure cannot be accurately set. Particularly, since a difference often occurs between the contact pressure in a position near the center portion and that near the edge portions with respect to the axial direction of the photosensitive body and the developing roller, even if the contact pressure is set by using the contact pressure in a position near the axial edge portion of the photosensitive body and the developing roller as a reference, the contact pressure in a position near the center portion has an uncertain value with respect to the axial direction of the photosensitive body and the developing roller.

SUMMARY OF THE INVENTION

It is an object of the invention to solve the above conventional problems and to provide a contact pressure setting method and an image forming apparatus in which a film member is inserted between contact members and a contact pressure between the contact members is set so that a force to pull out the film member lies within a predetermined range, so that the contact pressure can be accurately and easily recognized and can be set so as to be uniform.

According to the present invention, there is provided a contact pressure setting method of setting a contact pressure between contact members of an image forming apparatus, comprising the steps of inserting a film member into between the contact members; and setting the contact pressure so that a pulling force to pull out the film member lies within a predetermined range.

Moreover, according to the present invention, there is also provided a contact pressure setting method of setting a contact pressure between contact members of an image forming apparatus, comprising the steps of inserting a film member into between the contact members; and setting the contact pressure so that a frictional force between the film member and the contact members lies within a predetermined range.

Further, according to the present invention, there is provided an image forming apparatus for developing an electrostatic latent image on a photosensitive body by allowing the photosensitive body to be come into contact with a developing roller, wherein a contact pressure between the photosensitive body and the developing roller is set in such a manner that, when a strip-shaped polyethylene film whose thickness is equal to 0.03 [mm] and whose width is equal to 5 [mm] is inserted into between the photosensitive body and the developing roller which are in a stationary state, a frictional force between the polyethylene film and both of the photosensitive body and the developing roller is equal to or larger than 30 [gf].

In the image forming apparatus, the frictional force in an edge portion in an axial direction of each of the photosensitive body and the developing roller is equal to or less than two times of the frictional force in a center portion in an axial direction.

Moreover, in the image forming apparatus, by making pressing forces in both edge portions in an axial direction for pressing the photosensitive body and the developing roller different, the frictional forces in both of the edge portions in an axial direction are set to be almost equal.

Moreover, in the image forming apparatus, the frictional force is set to a value within a range from 30 to 250 [gf].

Moreover, the image forming apparatus may comprise a position adjusting section to adjust position of the developing roller with respect to the photosensitive body in order to set the contact pressure.

Moreover, in the image forming apparatus, the position adjusting section may have a decentering and supporting portion to decenter and support axis of the developing roller, and may rotate the decentering and supporting portion in order to adjust position of the developing roller with respect to the photosensitive body.

Moreover, in the image forming apparatus, the position adjusting section further may have a fixing portion to fix the decentering and supporting portion after adjustment of the position of the developing roller.

Moreover, the image forming apparatus may further comprise a supplying roller which contacts with the developing roller and is used to supply developer to the developing roller, wherein the supplying roller is coupled with the developing roller so that position of the supplying roller simultaneously changes together with that of the developing roller.

In the contact pressure setting method and the image forming apparatus, the contact pressure can be accurately and easily recognized and the contact pressure can be set to be uniform.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Figure 1:
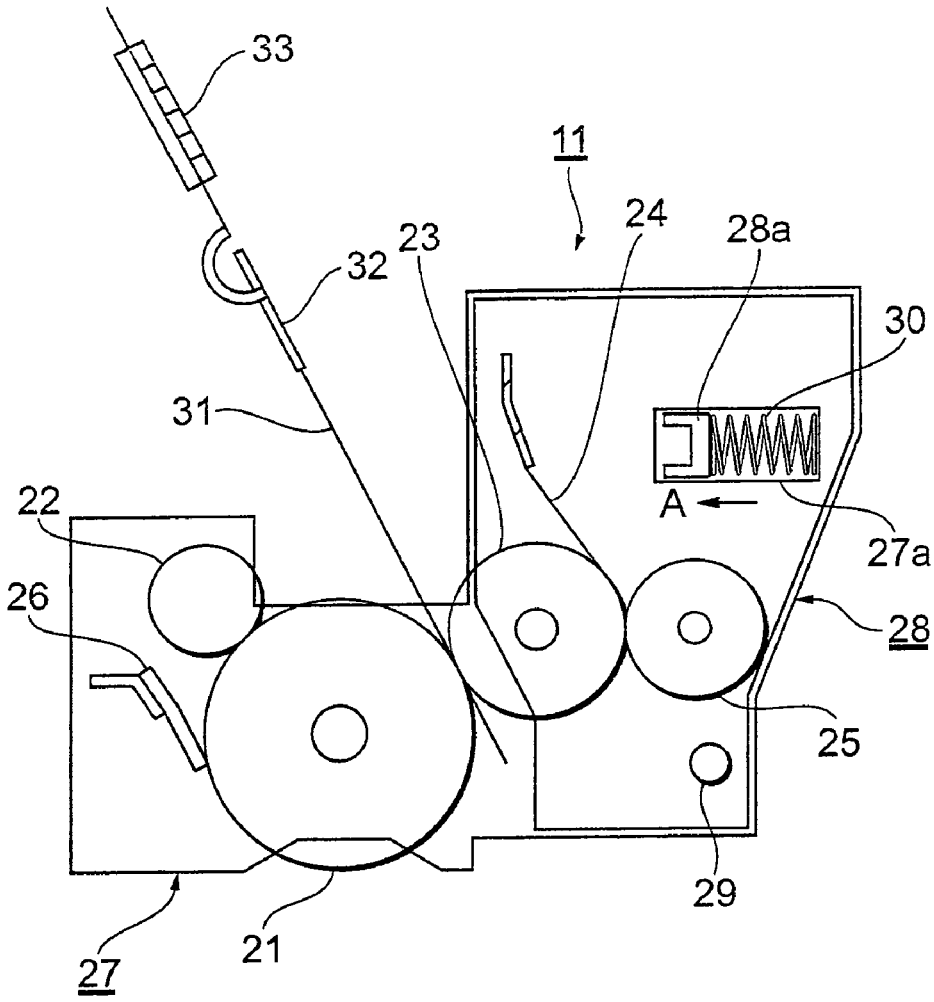
FIG. 1 is a cross sectional view of a developing apparatus in the first embodiment of the invention.
Figure 4:
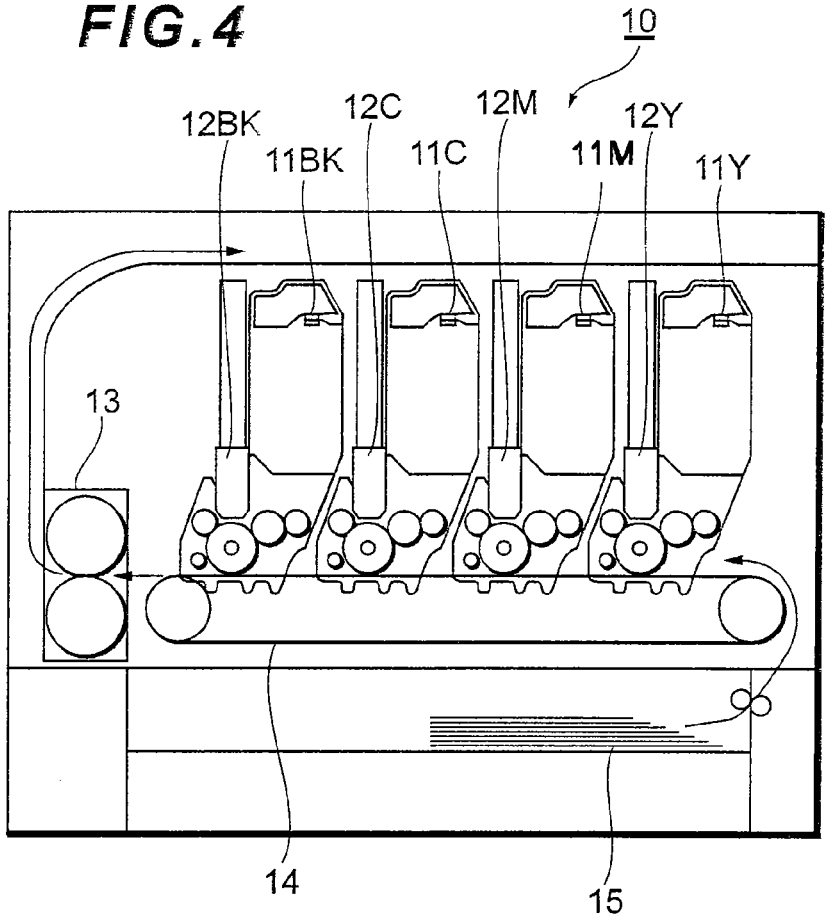
FIG. 4 is a schematic diagram of an image forming apparatus of a color LED tandem type in the first embodiment of the invention.

FIG. 1 is a cross sectional view of a developing apparatus in the first embodiment of the invention. FIG. 4 is a schematic diagram of an image forming apparatus of a color LED tandem type in the first embodiment of the invention.

In FIG. 4, reference numeral 10 denotes an image forming apparatus in the embodiment. The image forming apparatus 10 is, for example, a printer, a facsimile, a copying apparatus, or the like and forms a monochromatic or color image onto a medium such as print paper, envelope, OHP (Over Head Projector) sheet, or the like by an electrophotographic system. Although the image forming apparatus 10 is either a type which forms a monochromatic image or a type which forms a color image, explanation will now be made on the assumption that the image forming apparatus 10 forms a color image by the color LED tandem system. In this case, developing apparatuses 11Y, 11M, 11C, and 11BK corresponding to the colors of yellow (Y), magenta (M), cyan (C), and black (BK) are sequentially arranged along a conveying path of the medium. The developing apparatuses 11Y, 11M, 11C, and 11BK have exposing apparatuses 12Y, 12M, 12C, and 12BK, respectively. In the case of integratedly explaining the developing apparatuses 11Y, 11M, 11C, and 11BK, they are explained as a developing apparatus 11. In the case of integratedly explaining the exposing apparatuses 12Y, 12M, 12C, and 12BK, they are explained as an exposing apparatus 12.

The image forming apparatus 10 has: a medium conveying apparatus which has a paper feed tray 15 to enclose a number of media, a paper feeding roller, a conveying roller, a transfer belt 14 as a transfer apparatus, and the like and conveys the medium; a driving apparatus having motors, gears, belts, and the like (all are not shown) for driving movable members such as various rollers and the like of the developing apparatus 11, a fixing apparatus 13, and a recording medium conveying apparatus; a control apparatus which has an operation panel, a communication interface, and the like (all are not shown) and controls the operation of the image forming apparatus 10.

As shown in FIG. 1, the developing apparatus 11 has: a photosensitive body 21 as an electrostatic latent image holding body constructed by a conductive base layer made of aluminum or the like and a surface layer made of an organic photosensitive body; a charging roller 22 as a charging apparatus obtained by forming a semiconductive rubber such as epichlorohydrine rubber or the like in a roll shape onto a conductive metal shaft; a developing roller 23 as a developing agent holding body obtained by forming a semiconductive rubber such as silicone or the like onto a conductive metal shaft; a toner supplying roller 25 formed by adding a foaming agent to a conductive metal shaft at the time of rubber kneading in order to improve conveying performance of the toner; a developing blade 24 for uniformly restricting the thin toner layer on the developing roller 23; and a cleaning apparatus 26.

The embodiment will be explained with respect to the case where the photosensitive body 21 and the developing roller 23 function as contact members. In FIG. 1, reference numeral 27 denotes a first side frame having a spindle member 29 and a groove portion 27*a*. A convex portion 28*a* serving as a point of application is inserted into the groove portion 27*a* from a second side frame 28, which will be explained hereinafter, and pressed by a spring 30 in the direction shown by an arrow A. Reference numeral 31 denotes a strip-shaped film as a film member. One end of the film 31 is inserted into a contact portion of the photosensitive body 21 and the developing roller 23 and the other end is fixed to a plate 32 formed with a hole into which a terminal of a tension gauge 33 serving as a extension spring balance can be inserted. As will be explained hereinafter, the strip-shaped film 31, the plate 32, and the tension gauge 33 are used when a contact pressure between the contact members is set and removed when the image forming apparatus 10 executes an image forming process.

The charging roller 22, the developing roller 23, and the cleaning apparatus 26 are arranged so as to be in contact with the photosensitive body 21. The developing blade 24 and a toner supplying roller 25 are provided for the developing roller 23 so as to be in contact with each other. Further, the developing apparatus 11 has the exposing apparatus 12 to form an electrostatic latent image onto the charged surface of the photosensitive body 21. In the embodiment, the exposing apparatus 12 is an LED head constructed by combining an LED array and SELFOC lens array (registered trademark). The exposing apparatus 12 exposes by energy of light irradiated from the LED head and forms the electrostatic latent image onto the charged surface of the photosensitive body 21. A developing roller power source, a toner supplying roller power source, and a developing blade power source (which are not shown) are respectively connected to the developing roller 23, the toner supplying roller 25, and the developing blade 24, thereby enabling a bias voltage to be applied.

The fixing apparatus 13 has a heating roller as a fixing roller. The medium ejected from the developing apparatus 11 is heated and sandwiched between both sides and come into pressure contact, thereby fixing the toner image onto the medium.

In the image forming process of the image forming apparatus 10, the photosensitive body 21 is driven by a driving apparatus (not shown) and rotated clockwise in FIG. 1 at a constant peripheral velocity. The charging roller 22, the developing roller 23, and the toner supplying roller 25 are also driven by the driving apparatus (not shown) and rotated counterclockwise in FIG. 1, respectively. Since the charging roller 22 is arranged so as to be come into contact with the surface of the photosensitive body 21 or come into pressure contact therewith and a DC voltage is applied to the charging roller 22 from a high voltage power source, the surface of the photosensitive body 21 is uniformly charged. When the charged surface reaches the position which faces the exposing apparatus 12 by the rotation of the photosensitive body 21, the light corresponding to an image signal is irradiated to the charged surface by the exposing apparatus 12, so that the electrostatic latent image is formed onto the charged surface of the photosensitive body 21.

Subsequently, when the surface on which the electrostatic latent image has been formed reaches the position which faces the developing roller 23 by the rotation of the photosensitive body 21, the toner is supplied from the developing roller 23. The toner is adhered onto the surface of the photosensitive body 21, so that the toner image is formed. The toner enclosed in the developing apparatus 11 has been charged by friction and supplied to the developing roller 23 by the rotation of the toner supplying roller 25 to which the bias voltage has been applied. The toner layer of a uniform thickness made of the toner adhered on the surface of the developing roller 23 is formed by the developing blade 24 arranged so as to be come into pressure contact with the surface of the developing roller 23.

For example, when a reversal development is executed, the bias voltage is applied across the conductive base layer of the photosensitive body 21 and the developing roller 23. Therefore, an electric line of force due to the electrostatic latent image formed on the surface of the photosensitive body 21 is generated. The charged toner on the developing roller 23 is moved to the surface of the photosensitive body 21 by the force of static electricity and adhered thereto and the developed toner image is formed.

Subsequently, the medium enclosed on the paper feed tray is picked up therefrom by the supplying roller and conveyed by the transfer belt 14. When the medium passes through a transfer portion as a lower portion of the developing apparatus 11, the bias voltage is applied to the transfer portion, so that the toner image on the surface of the photosensitive body 21 is transferred onto the surface of the medium.

Then, the medium is fed to the fixing apparatus 13, sandwiched between both sides and heated by the heating roller which is rotated by the driving apparatus (not shown), and pressed. Thus, the toner constructing the toner image is fused by the heat of the heating roller. The fused toner is impregnated into fibers of the medium by the pressing action, so that the toner image is fixed. The medium to which the toner image has been adhered is ejected to an upper portion of the image forming apparatus 10.

The developing apparatus 11 will now be described in detail.

Figure 2:
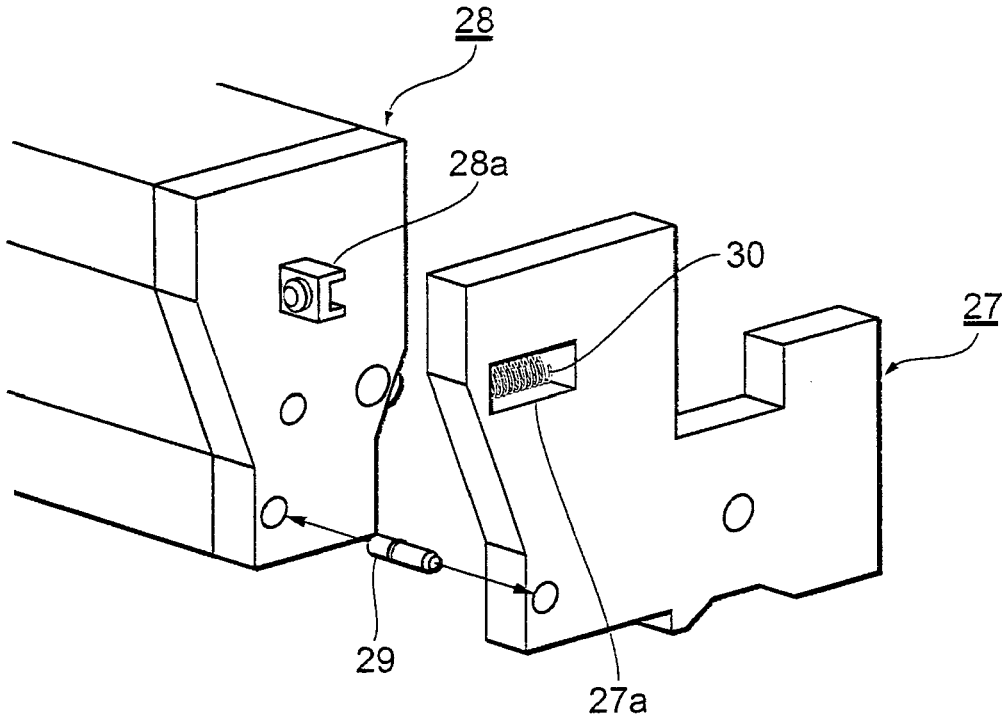
FIG. 2 is a perspective view of a side frame in the first embodiment of the invention.
Figure 3:
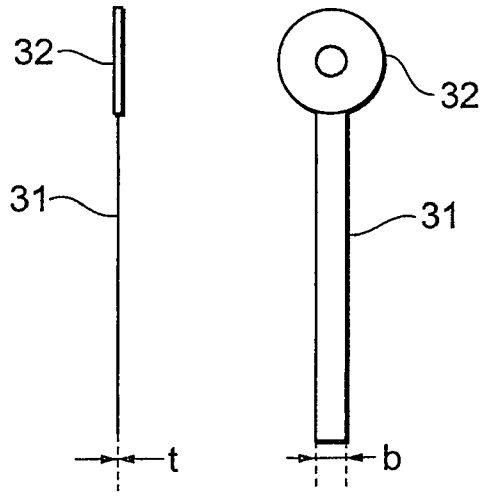
FIG. 3 is a detailed diagram of a film in the first embodiment of the invention.

FIG. 2 is a perspective view of a side frame in the first embodiment of the invention. FIG. 3 is a detailed diagram of the film in the first embodiment of the invention.

In the embodiment, the photosensitive body 21 and the charging roller 22 are supported to the first side frames 27 arranged on the right and left sides in the axial direction of the photosensitive body 21. The developing roller 23, the toner supplying roller 25, and the developing blade 24 are supported to the second side frames 28 arranged on both of the right and left side portions in the axial direction, thereby constructing a developing unit. Further, on the inside of the first side frames 27 arranged in the right and left side portions in the axial direction, the developing unit is supported by the spindle members 29 arranged in the first side frames 27.

To allow the developing roller 23 to be come into contact with the photosensitive body 21 and press it, the groove portion 27*a* is formed in the first side frame 27. As shown in FIG. 2, the convex portion 28*a* serving as a point of application is inserted into the groove portion 27*a* from the second side frame 28 and pressed by the spring 30. In this case, since the spring 30 presses the convex portion 28*a* in the direction shown by the arrow (A) in FIG. 1, the developing unit is rotated around the spindle members 29 as a fulcrum and the developing roller 23 is come into contact with the photosensitive body 21 and presses it.

For example, a spring receiving member adapted to be spirally come into engagement with a screw rod is provided for the convex portion 28*a*, one end of the spring 30 is come into contact with the spring receiving member, and the spring receiving member is rotated on the screw rod, so that a pressing force of the spring 30 can be adjusted.

As shown in FIG. 3, the strip-shaped film 31 has a thickness t and a width b and fixed to the plate 32 having a hole. In the embodiment, when the contact pressure of the photosensitive body 21 and the developing roller 23 is set, as shown in FIG. 1, a terminal of the tension gauge 33 is inserted into the hole of the plate 32 and one end of the strip-shaped film 31 is inserted into the contact portion of the photosensitive body 21 and the developing roller 23. At this time, the toner layer is formed on the peripheral surface of the developing roller.

A contact pressure setting method in the embodiment will now be described.

First, and one end of the strip-shaped film 31 is inserted into the contact portion of the photosensitive body 21 and the developing roller 23 of the developing apparatus 11 in the stationary state. In this instance, it is inserted so that a front edge of the film 31 is slipped by an amount of about 10 to 30 [mm] from the contact portion.

A terminal of the tension gauge 33 is inserted into the hole of the plate 32 fixed to the other end of the film 31. In this state, as shown in FIG. 1, at a contact point of the photosensitive body 21 and the developing roller 23, the tension gauge 33 is arranged so as to stretch the film 31 in the direction perpendicular to the line connecting the axial center of the photosensitive body 21 and that of the developing roller 23. In this state, at the contact point of the photosensitive body 21 and the developing roller 23, the tension gauge 33 is moved so as to pull out the film 31 in the direction perpendicular to the line connecting the axial center of the photosensitive body 21 and that of the developing roller 23, and a pointer of the tension gauge 33 at this time is read. Since the pointer indicates a force to pull out the film 31, that is, a pulling force of the film 31, by reading the pointer of the tension gauge 33, the pulling force of the film 31 can be measured. In this instance, the developing roller 23 and the photosensitive body 21 are fixed so as not to rotate.

In the case of reading the pointer, the value in the case where the pointer starts to move when the tension gauge 33 is moved is not read but since the pointer indicates the stable value if the tension gauge 33 is slowly moved as it is, the value at this time is read. In other words, a dynamic frictional force instead of a static frictional force is measured as a pulling force of the film 31.

Subsequently, when an insertion margin of the film 31 is extinguished, the tension of the film 31 is released, so that the pointer of the tension gauge 33 is naturally returned to the original value. The larger the insertion margin of the film 31 is, the longer the time during which the stable pointer of the tension gauge 33 can be read is. In this case, however, attention is paid so that a wrinkle which becomes a load of the film 31 is not formed.

The pressing force of the spring 30 is adjusted and set so that a numerical value of the measured pulling force of the film 31 is equal to a predetermined numerical value. Since the pulling force of the film 31 changes in proportion to the contact pressure of the photosensitive body 21 and the developing roller 23, by adjusting and setting the pressing force of the spring 30 so that the numerical value of the pulling force of the film 31 is equal to the predetermined numerical value, the contact pressure of the photosensitive body 21 and the developing roller 23 can be set to a predetermined numerical value. That is, since there is a proportional relation between the contact pressure of the photosensitive body 21 and the developing roller 23 and the dynamic frictional force measured as a pulling force of the film 31, by previously obtaining a numerical value range of the dynamic frictional force in the numerical value range of the good contact pressure and adjusting and setting the pressing force of the spring 30 so that the numerical value of the pulling force of the film 31 lies within the numerical value range, the contact pressure can be set to the good numerical value range. The numerical value range of the good contact pressure can be determined by actually forming an image and using quality of the formed image as a reference.

As mentioned above, in the embodiment, the contact pressure of the photosensitive body 21 and the developing roller 23 in the image forming apparatus 10 is set so that the pulling force of the film 31 lies within the predetermined numerical value range. Therefore, the contact pressure can be directly recognized and can be accurately and easily set. Thus, the contact pressure of the photosensitive body 21 and the developing roller 23 can be set to a uniform value. Since the developing roller 23 as an elastic body made of a resin is not elastically deformed if the thickness of film 31 is small, the contact state is not changed.

Further, in the axial direction of the photosensitive body 21, the contact pressure can be finely set irrespective of the location near the edge portions, near the center, or the like. That is, it can be also finely set even in the case of a shape having a crown amount (shape in which an outer diameter of the roller edge portion is decreased in the edge portion direction so as to be inclined) in consideration of a deflection of a shaft which is come into contact with the developing roller 23.

Although the embodiment has been described with respect to the case where the contact pressure of the photosensitive body 21 and the developing roller 23 is set by assuming that the contact members are the photosensitive body 21 and the developing roller 23, the contact members may be the developing roller 23 and the developing blade 24 or the photosensitive body 21 and the charging roller 22. The contact pressure of the developing roller 23 and the developing blade 24 or the contact pressure of the photosensitive body 21 and the charging roller 22 can be also set.

The second embodiment of the invention will now be described. Component elements having substantially the same constructions as those in the first embodiment are designated by the same reference numerals and their description is omitted here. Explanation of substantially the same operation and effect as those in the first embodiment is also omitted here.

In the image forming apparatus 10 in the embodiment, the developing roller 23 is obtained by coating a metal shaft with a silicone resin and, further, forming a silicone system charging applying surface layer onto the surface. An external shape of the developing roller 23 is a straight shape having no crown amount. It is preferable that the film 31 is made of a polyethylene resin (surface roughness Rz is equal to or less than 50 [μm]) and is in a strip-shape having a thickness of 0.03 [mm] and a width of 5 [mm].

The contact pressure setting method described in the first embodiment is executed and the pressing force of the spring 30 is set so that the photosensitive body 21 is come into contact with the developing roller 23 with such a contact pressure that the pulling force of the film 31 lies within a range of 30 to 250 [gf].

The operation of the image forming apparatus 10 in the embodiment will now be described.

Figure 5:
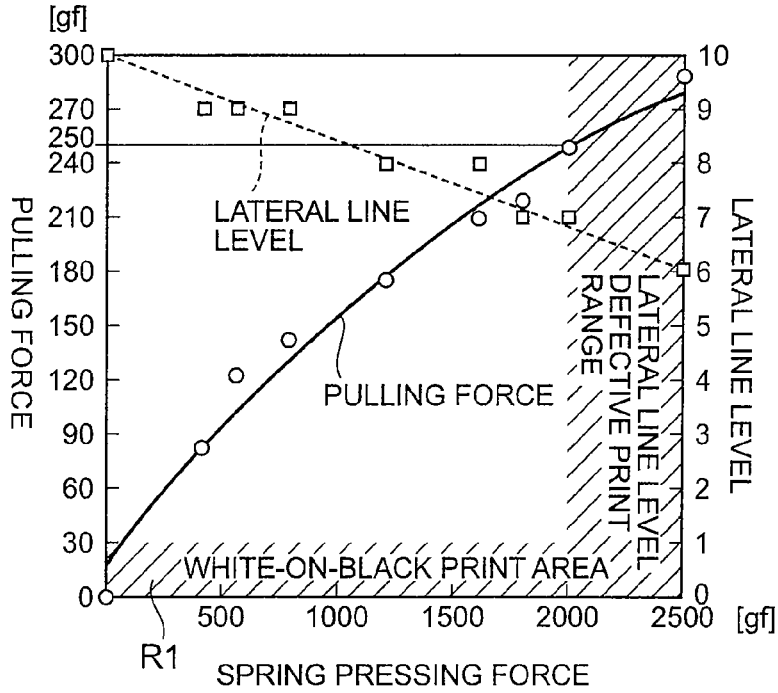
FIG. 5 is a diagram showing a relation between a pressing force of a spring and a pulling force of a film in the second embodiment of the invention.

FIG. 5 is a diagram showing a relation between the pressing force of the spring and the pulling force of the film in the second embodiment of the invention. In FIG. 5, an axis of abscissa denotes the pressing force of the spring and an axis of ordinate indicates the pulling force of the film 31 and a lateral line generating level when a print result is visually inspected.

In this instance, the pressing force of the spring 30 is changed, the printing is executed, the pulling force of the film 31 corresponding to the pressing force of the spring 30 is measured, the surface of the printed medium, that is, a print result is visually inspected, and the lateral line generating level is measured. A measurement result is as shown in FIG. 5. The lateral line generating level is (the level is set by the visual inspection on the basis of a density of a black line generated on a lateral line as a reference) is discriminated on the basis of a reference sample. The larger a numerical value is, the higher the lateral line generating level is. That is, it means that the print result is better and a value of level 7 or more is assumed to be a good print range.

As shown in FIG. 5, when the pressing force of the spring 30 increases, the pulling force of the film 31 also increases.

R1 denotes a white-on-black print area where a white-on-black state occurs when the print result is visually inspected. The portion where an image pattern of "2by2" is printed and no dots are printed but blurred in white is assumed to be a white-on-black print area. In this case, pattern printing of an image to form (2×2) dots to the corner of (4×4) cells is executed at a resolution of the print dots=1 dot. A repetitive pattern of the image pattern is an image pattern called "2by2".

It will be understood from FIG. 5 that the white-on-black portion occurs at a boundary line where the pulling force of the film 31 is equal to 30 [gf]. That is, to prevent the occurrence of the white-on-black portion in the print result, it is preferable that the contact pressure of the photosensitive body 21 and the developing roller 23 is set to a value which is equal to or larger than 30 [gf] as a pulling force of the film 31. Therefore, by setting the pulling force to 30 [gf] or more over the whole axial directional region, the contact pressure state where no white-on-black portions occur can be set and the good image forming apparatus 10 can be provided.

It will be understood from FIG. 5 that the larger the pressing force of the spring 30 is, the more the lateral line generating level deteriorates. In this case, the lateral line level is less than the preferable print range at the boundary line where the pulling force of the film 31 is equal to 250 [gf]. This is because although the pulling force of the film 31 increases when the pressing force of the spring 30 is increased, the pulling force acts in such a direction that it contrarily becomes a load at the time of the operation. In other words, in order to obtain the preferable print range where no white-on-black portions occur in the print result and no lateral lines occur, it will be understood that it is preferable to set the contact pressure of the photosensitive body 21 and the developing roller 23 to a value within a range from 30 to 250 [gf] as a pulling force of the film 31.

As mentioned above, in the embodiment, by directly, accurately, and easily setting the contact pressure of the photosensitive body 21 and the developing roller 23 in the image forming apparatus 10 as a pulling force of the film 31, the contact pressure of the photosensitive body 21 and the developing roller 23 is set to the value within the range from 30 to 250 [gf] as a pulling force of the film 31. Thus, the preferable print range where no white-on-black portions occur and no lateral lines occur in the print result can be obtained.

The third embodiment of the invention will now be described. Component elements having substantially the same constructions as those in the first and second embodiments are designated by the same reference numerals and their description is omitted here. Explanation of substantially the same operation and effect as those in the first and second embodiments is also omitted here.

Figure 6:
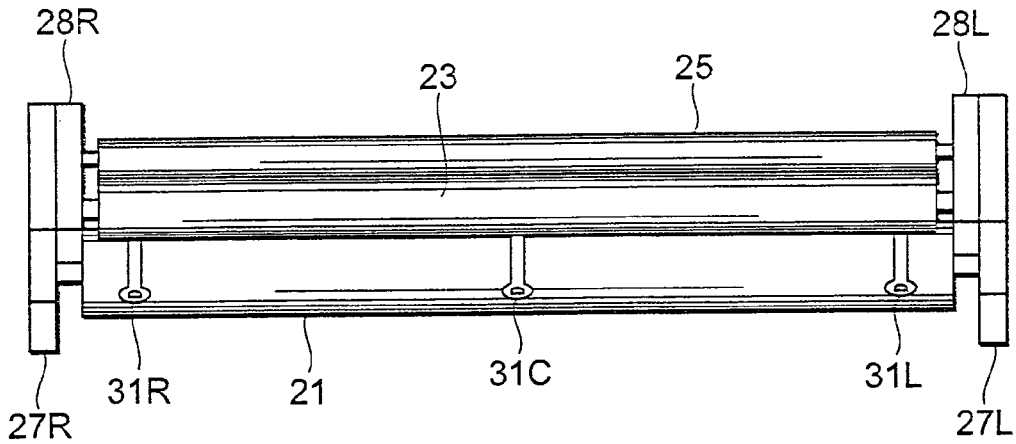
FIG. 6 is a diagram showing positions to measure a contact pressure of a photosensitive body and a developing roller in the third embodiment of the invention.

FIG. 6 is a diagram showing positions to measure a contact pressure of a photosensitive body and a developing roller in the third embodiment of the invention.

In the embodiment, in the case of setting the contact pressure of the photosensitive body 21 and the developing roller 23, the spring 30 is set so that a pulling force of a film 31R in the right edge portion and a pulling force of a film 31L in the left edge portion with respect to the axial direction of the photosensitive body 21 are equal to or less than twice as large as a pulling force of a film 31C in the center portion. In FIG. 6, reference numeral 27R denotes a first side frame on the right side, 28R a second side frame on the right side, 27L a first side frame on the left side, and 28L a second side frame on the left side.

The operation of the image forming apparatus 10 in the embodiment will now be described.

Figure 7:
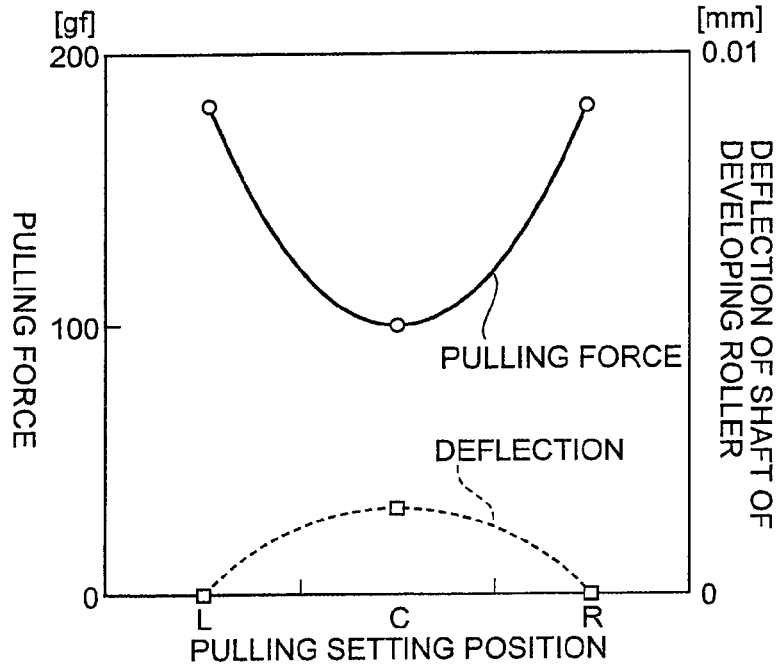
FIG. 7 is a diagram showing relations among a position in an axial direction of the photosensitive body, a pulling force, and a deflection amount of a shaft of a developing roller in the third embodiment of the invention.

FIG. 7 is a diagram showing relations among a position in an axial direction of the photosensitive body, a pulling force, and a deflection amount of a shaft of a developing roller in the third embodiment of the invention. In FIG. 7, an axis of abscissa denotes the position in the axial direction of the photosensitive body 21 and an axis of ordinate indicates the pulling force of the film 31 and the deflection amount of the shaft of the developing roller 23.

On the axis of abscissa, R denotes a position of the film 31R in the right edge portion; L a position of the film 31L in the left edge portion; and C a position of the film 31C in the center portion. The pulling force of the film 31 corresponds to the case where the contact pressure of the photosensitive body 21 and the developing roller 23 is set to the pulling force of the film 31. Further, the deflection amount of the shaft of the developing roller 23 is a simulation result obtained by analyzing the structure.

As shown in FIG. 7, the pulling force of the film 31R in the right edge portion and that of the film 31L in the left edge portion with respect to the axial direction of the photosensitive body 21 are larger than the pulling force of the film 31C in the center portion (convex downwardly). It is inversely proportional to the deflection amount of the shaft of the developing roller 23 (convex upwardly). That is, it will be understood that although the edge portion of the shaft of the developing roller 23 to which the pressing force is applied by the spring 30 is not deflected, the shaft of the developing roller 23 is deflected in the center portion, so that a nip amount of the photosensitive body 21 and the developing roller 23 decreases and, consequently, the pulling force by the film 31 decreases.

The case where the pressing force of the spring 30 is changed will now be described.

Figure 8:
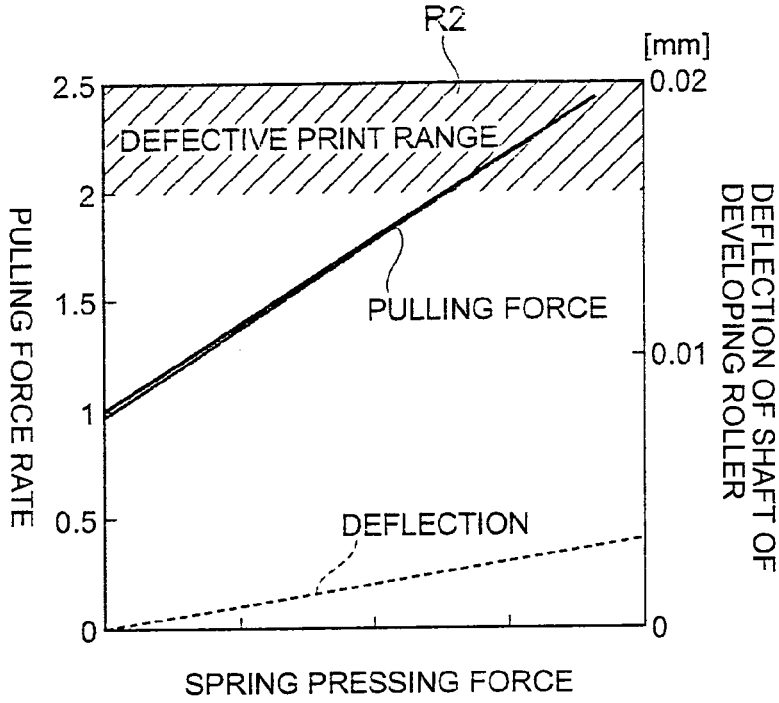
FIG. 8 is a diagram showing a rate of a spring pressing force to the pulling force and a relation with the deflection amount of the shaft of the developing roller in the third embodiment of the invention.

FIG. 8 is a diagram showing a rate of the spring pressing force to the pulling force and a relation with the deflection amount of the shaft of the developing roller in the third embodiment of the invention. In FIG. 8, an axis of abscissa denotes the pressing force of the spring 30 and an axis of ordinate indicates a rate of the pulling force by the film 31R in the right edge portion and that of the film 31L in the left edge portion with respect to the axial direction of the photosensitive body 21 to the pulling force by the film 31C in the center portion (the pulling force of the edge portion/the pulling force in the center portion) and the deflection amount of the shaft of the developing roller 23.

The deflection amount of the shaft of the developing roller 23 is the maximum value of the deflection amount as a simulation result obtained by the structure analysis. Further, R2 denotes a range of the defective print (the print image is densely seen due to the occurrence of crush of the dots or a deviation of a pitch of the dots) such as concentration variation (the concentration becomes partially dense in the printing of 2by2), lateral line (the concentration becomes dense in a line shape), or the like.

As shown in FIG. 8, when the pressing force of the spring 30 increases, the deflection of the shaft of the developing roller 23 increases, so that the nip amount of the photosensitive body 21 and the developing roller 23 in the center portion with respect to the axial direction of the photosensitive body 21 decreases. Therefore, as shown in FIG. 7, since the shape which is downwardly convex further becomes elongated, the rate of the pulling force by the film 31R in the right edge portion and that of the film 31L in the left edge portion with respect to the axial direction of the photosensitive body 21 to the pulling force by the film 31C in the center portion increases.

The defective print range R2 shows a range where the rate of the pulling force by the film 31R in the right edge portion and that of the film 31L in the left edge portion with respect to the axial direction of the photosensitive body 21 to the pulling force by the film 31C in the center portion is equal to or larger than 2 is set to a boundary line. Therefore, in the developing roller 23 having no crown amount, by setting the spring 30 so that the rate of the pulling force by the film 31R in the right edge portion and that of the film 31L in the left edge portion with respect to the axial direction of the photosensitive body 21 to the pulling force by the film 31C in the center portion is equal to or less than 2, the occurrence of the defective printing can be prevented.

As mentioned above, in the embodiment, even in the developing roller 23 having no crown amount, by setting the rate of the pulling force by the film 31R in the right edge portion and that of the film 31L in the left edge portion with respect to the axial direction of the photosensitive body 21 to the pulling force by the film 31C in the center portion is equal to or less than 2, the occurrence of the defective print range R2 can be prevented. In other words, although it is demanded that the contact pressure of the photosensitive body 21 and the developing roller 23 in the image forming apparatus 10 is uniform anywhere in the axial direction of the photosensitive body 21, even if no crown amount is provided for the developing roller 23, the occurrence of the defective print range R2 can be prevented.

The fourth embodiment of the invention will now be described. Component elements having substantially the same constructions as those in the first to third embodiments are designated is by the same reference numerals and their description is omitted here. Explanation of substantially the same operation and effect as those in the first to third embodiments is also omitted here.

Figure 9:
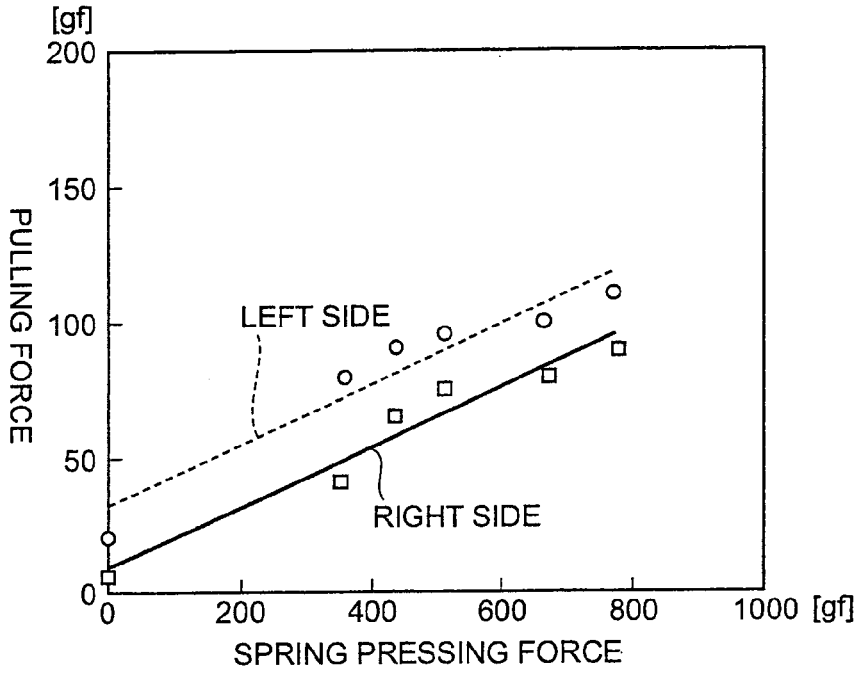
FIG. 9 is a diagram showing a relation between a spring pressing force and a pulling force of a film in the fourth embodiment of the invention.
Figure 10:
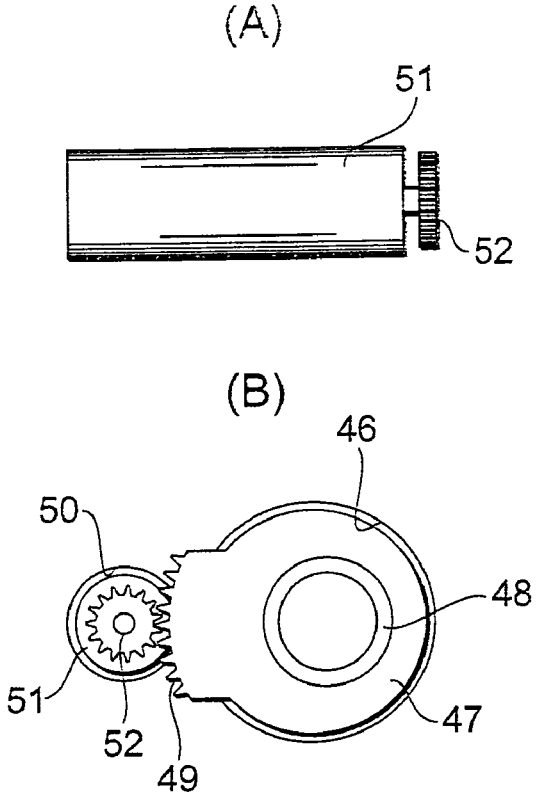
FIG. 10A is a side elevational view of an adjusting tool according to the fifth embodiment of the invention.
FIG. 10B is a front view showing a relation between the adjusting tool and an eccentric mechanism.

FIG. 9 is a diagram showing a relation between a spring pressing force and a pulling force of a film in the fourth embodiment of the invention. In FIG. 9, an axis of abscissa denotes the pressing force of the spring 30 and an axis of ordinate indicates the pulling force of the film 31.

The pulling force of the film 31 corresponds to the case where the contact pressure of the photosensitive body 21 and the developing roller 23 is set to the pulling force of the film 31. Further, a solid line indicates the pulling force on the right side in the axial direction of the photosensitive body 21 and a broken line indicates the pulling force on the left side in the axial direction of the photosensitive body 21. In the embodiment, the spring 30 to press the photosensitive body 21 and the developing roller 23 so as to be come into contact with each other is set by the contact pressure setting method for the photosensitive body 21 and the developing roller 23 so that the pulling force of the film 31R in the right edge portion and that of the film 31L in the left edge portion with respect to the axial direction of the photosensitive body 21 are set to the same value.

The case where the pressing force of the spring 30 is changed will now be described.

As shown in FIG. 9, with respect to the right and left films, there is the same tendency in which, when the pressing force of the spring 30 increases, the pulling force of the film 31 also increases. However, in the spring 30 of the same force, a difference between the right and left pulling forces occurs. This is because the difference between the right and left pulling forces occurs due to dimensional precision of each part or the twist or deflection of members for holding the developing unit. Therefore, by changing either the right spring 30 or the left spring 30 so that the pulling force of the film 31R in the right edge portion and that of the film 31L in the left edge portion are set to the same value, the right and left pulling forces are stabilized. In the case of the example shown in FIG. 9, it will be understood that by increasing the pressing force of the spring 30 of the right side, the right and left pulling forces coincide.

As mentioned above, in the embodiment, since the contact pressure of the photosensitive body 21 and the developing roller 23 in the image forming apparatus 10 can be directly, accurately, and easily set as a pulling force of the film 31, by stabilizing the pulling force of the film 31 in the axial direction of the photosensitive body 21, the photosensitive body 21 and the developing roller 23 are properly come into contact with each other. When the electrostatic latent image on the photosensitive body 21 is developed, there is no variation in toner and the print quality can be improved.

The invention is not limited to the foregoing embodiments but many variations and modifications are possible on the basis of the spirit of the invention and are not excluded from the scope of the invention.

FIGS. 10A to 16 are diagrams showing the fifth embodiment of the invention. That is, in FIG. 11, reference numeral 40 denotes an image drum cartridge. The image drum cartridge 40 has: a photosensitive drum 41; a developing roller 42; left and right side plates 43 and 44 each for rotatably supporting the photosensitive drum 41 and the developing roller 42; a supplying roller (not shown); a charging roller (not shown); a cleaning blade (not shown); and the like.

The photosensitive drum 41 has a hollow drum main body made of aluminum alloy and a photosensitive layer coated on the surface thereof. The developing roller 42 has an elastic layer made of silicone rubber, urethane rubber, or the like.

Figure 12:
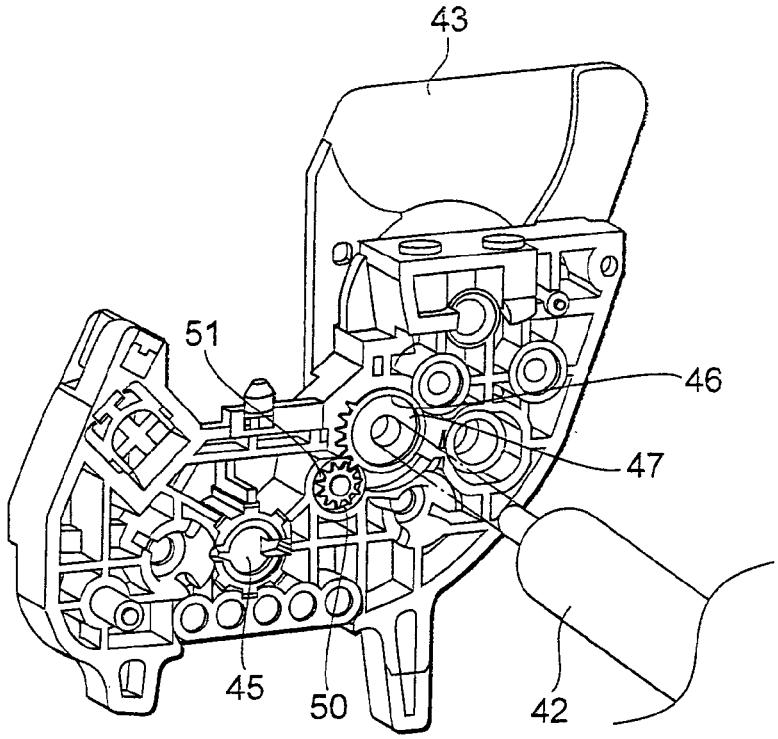
FIG. 12 is a perspective view of a side plate according to the fifth embodiment of the invention.

As shown in FIG. 12, each of the side plates 43 and 44 has a spindle hole 45 for rotatably and axially supporting a shaft of the photosensitive drum 41. At a position which is obliquely upwardly away from the spindle hole 45, each side plate has a circular spindle hole 46 for supporting the developing roller 42. An eccentric cam 47 is rotatably inserted into the spindle hole 46.

As shown in FIG. 10B, in the eccentric cam 47, a bearing 48 is fitted into a circular eccentric hole which is decentered from a rotational center. A sector gear 49 is integratedly formed in a part of a peripheral surface of the eccentric cam 47.

As shown in FIG. 12, an adjusting hole 50 of a small diameter which is neighboring to the spindle hole 46 is further formed in each of the side plates 43 and 44. An adjusting tool 51 is rotatably inserted into the adjusting hole 50. As shown in FIGS. 10A and 10B, a pinion gear 52 adapted to be come into engagement with the sector gear 49 is attached to a front edge of the adjusting tool 51. Therefore, by propagating a rotational force to the sector gear 49 through the pinion gear 52 by rotating the adjusting tool 51 inserted in the adjusting hole 50, the eccentric cam 47 can be rotated in the spindle hole 46. When the eccentric cam 47 is rotated as mentioned above, displacement occurs in the bearing 48 of the eccentric hole in accordance with an eccentric amount, so that displacement also occurs in the developing roller 42 which is rotatably and axially supported to the bearing 48. Thus, the pressing force to the peripheral surface of the photosensitive drum 41 can be adjusted.

The contact pressure setting method of the embodiment will now be described.

Figure 11:
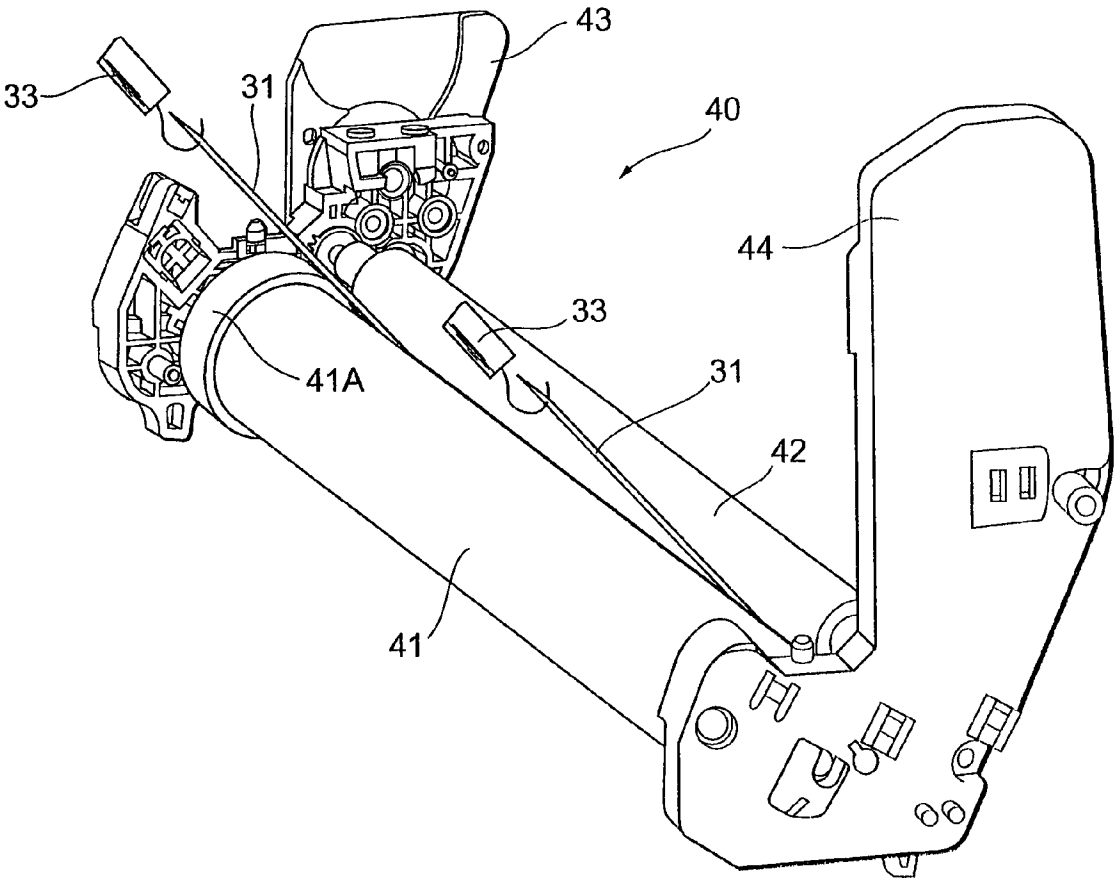
FIG. 11 is a perspective view showing a measuring method of a tractive force according to the fifth embodiment of the invention.
Figure 17:
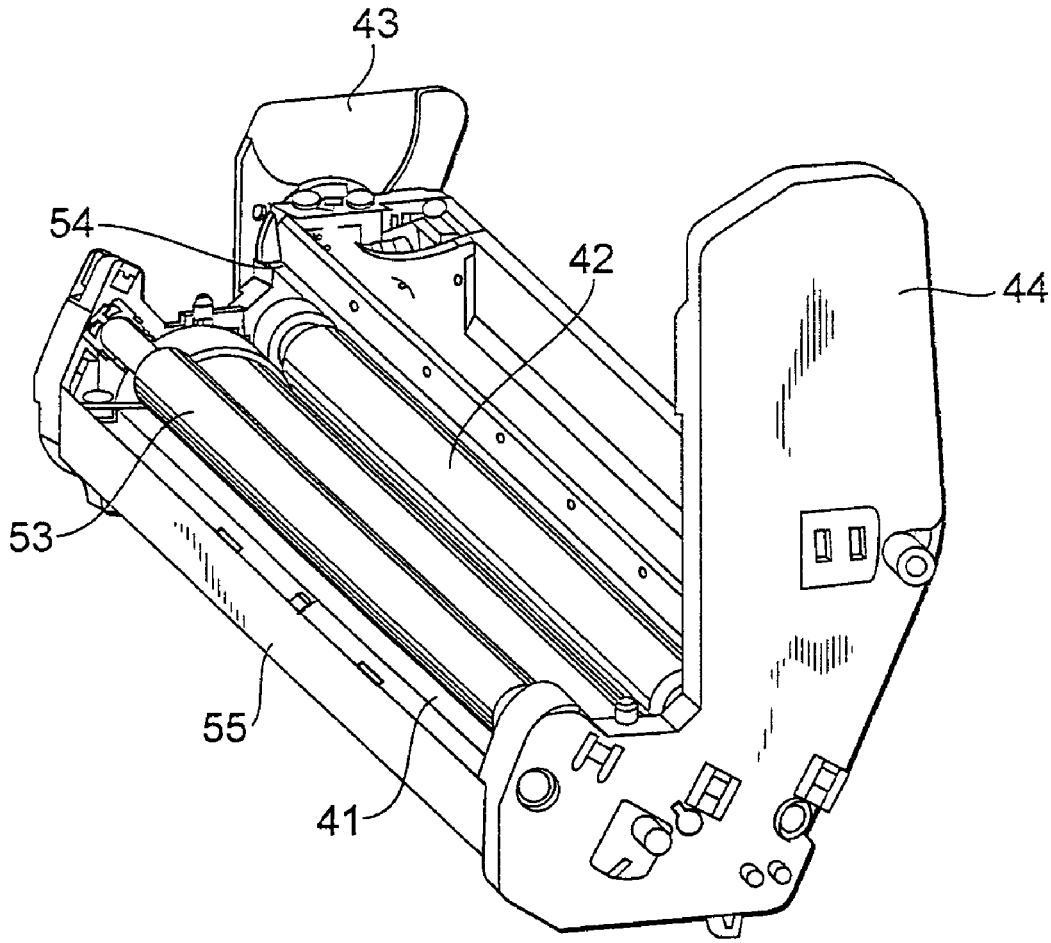
FIG. 17 is a perspective view showing the state at the time of measuring the tractive force of an image drum cartridge according to the invention.

First, as shown in FIG. 11, in the image drum cartridge 40, between the side plates 43 and 44, the photosensitive drum 41 is rotatably and axially supported into the spindle holes 45 (refer to FIG. 12) and the developing roller 42 is rotatably and axially supported to the eccentric cam 47 (refer to FIG. 12) of the spindle hole 46. As shown in FIG. 17, a supplying roller 56

(refer to FIG. 14), a charging roller 53, a developing blade 54, a lower cover 55, and the like are also equipped between the side plates 43 and 44.

Figure 14:
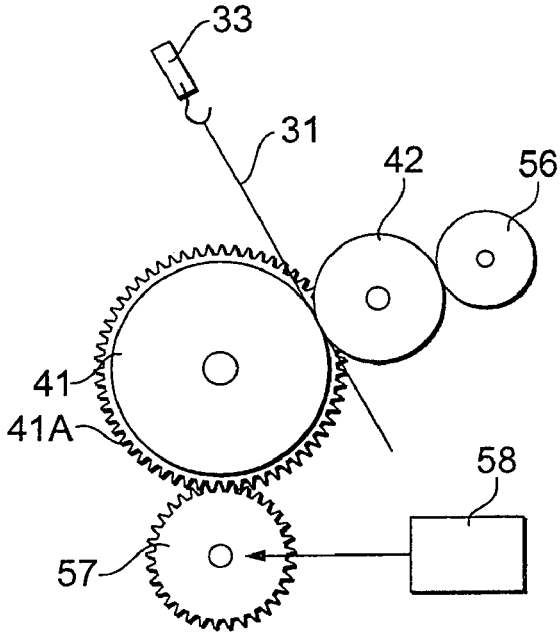
FIG. 14 is a schematic diagram showing the measuring method according to the fifth embodiment of the invention.

Subsequently, as shown in FIGS. 11 and 14, strip-shaped films 31 and 31 (refer to FIG. 3) are inserted between peripheral surfaces at both ends of the photosensitive drum 41 and the developing roller 42. As shown in FIG. 14, a drive gear 57 is come into engagement with a gear of a gear portion 41A in the end portion of the photosensitive drum 41 shown in FIG. 11. The drive gear 57 is rotated by a motor 58 through other gears. The drive gear 57, motor 58, and the like construct a driving unit which is exclusively used for adjustment.

Subsequently, the motor 58 is made operative, thereby rotating the photosensitive drum 41 through the drive gear 57 and the gear portion 41A. As mentioned above, when the photosensitive drum 41 is rotated, the developing roller 42 and the supplying roller 56 are also dependently rotated through a gear mechanism (not shown), so that the toner layer is formed on the peripheral surface of the developing roller 42. Since the photosensitive drum 41 and the developing roller 42 are rotated, a tractive force is applied to both of the films 31 and 31. This tractive force is measured by the tension gauge 33.

Figure 13:
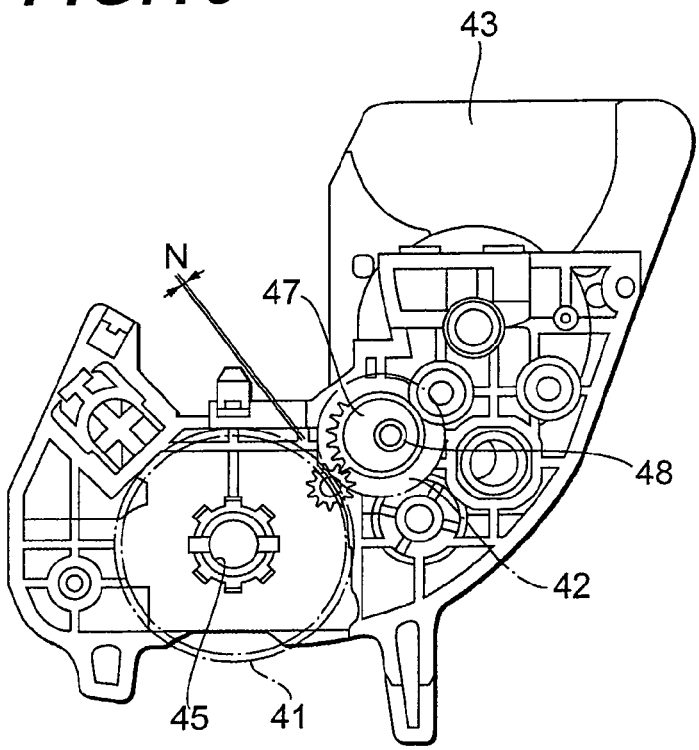
FIG. 13 is a front view of the side plate according to the fifth embodiment of the invention.
Figure 15:
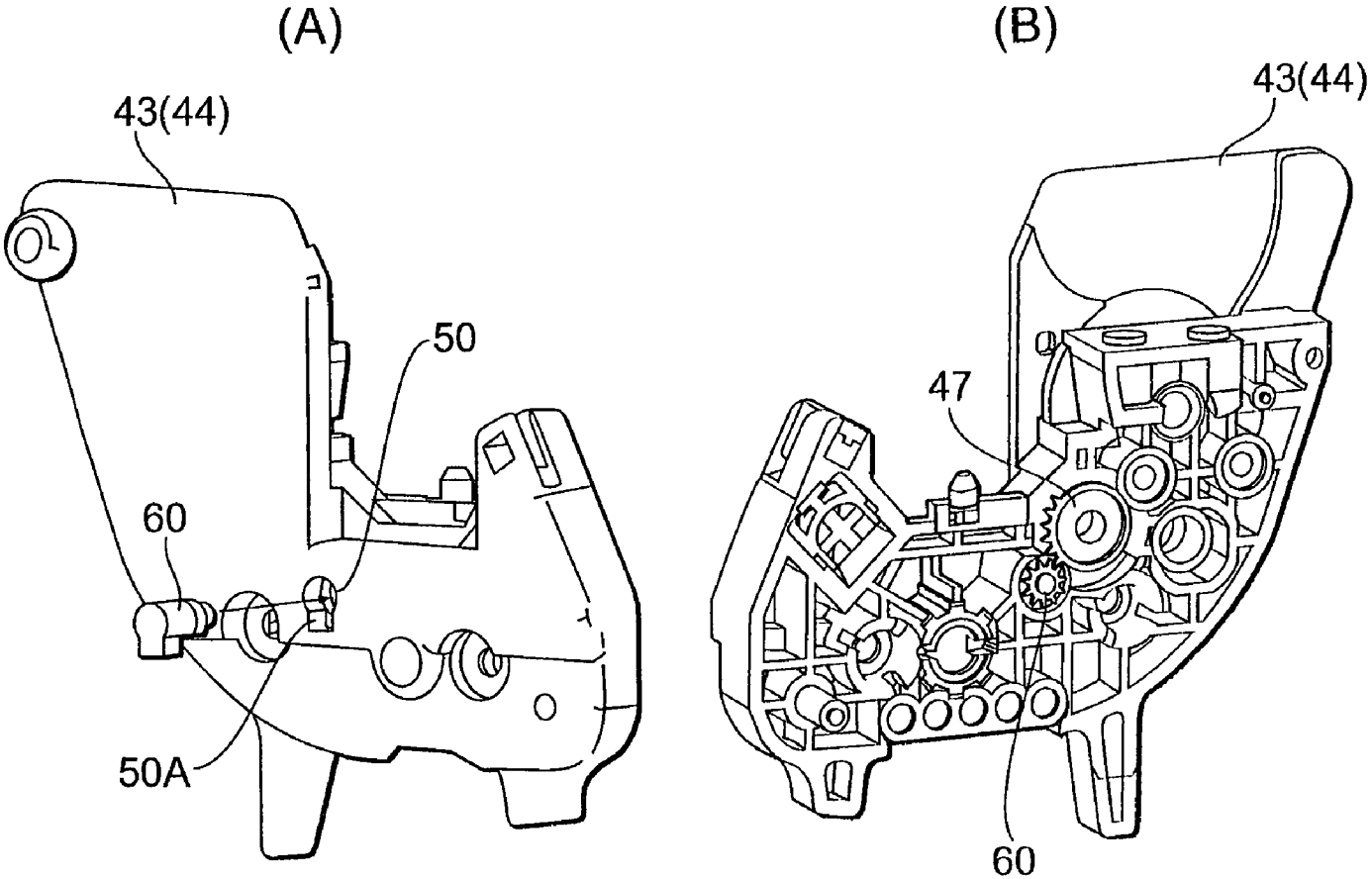
FIG. 15A is a perspective view showing a relation between a rotation blocking body and the side plate according to the fifth embodiment of the invention.
FIG. 15B is a perspective view showing the relation when seen from the opposite direction.

As shown in FIG. 13, if a nip amount (N) of the photosensitive drum 41 and the developing roller 42 is small, the tractive force to the films 31 is small. On the contrary, if the nip amount (N) is large, the tractive force increases.

In the embodiment, therefore, the tractive force of the film 31 is adjusted to about 200 [gf]. That is, as shown in FIGS. 10A and 10B, by inserting the adjusting tool 51 into the adjusting hole 50 of the side plate and rotating it, the eccentric cam 47 is rotated through the pinion gear 52 and the sector gear 49. Thus, since displacement occurs in the axis of the developing roller, the tractive force of the film 31 also fluctuates. Therefore, at a point when the tractive force of the film 31 measured by the tension gauge 33 is equal to about 200 [gf], the operation of the adjusting tool 51 is stopped and pulled out of the adjusting hole 50. At the same time, the operation of the motor 58 is stopped, thereby disengaging the drive gear 57.

Figure 16:
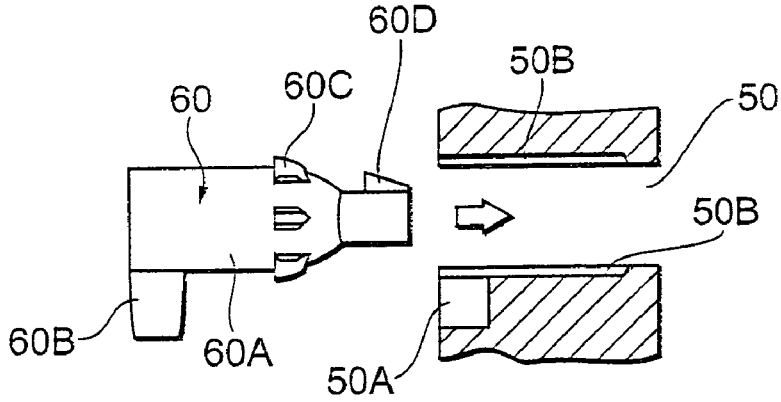
FIG. 16 is a front view showing a relation between the rotation blocking body and an adjusting hole.

Subsequently, the eccentric cam 47 is fixed in order to prevent the rotation. That is, as shown in FIGS. 15A and 15B, a key-shaped hole 50A which is integratedly communicating with the adjusting hole 50 is formed on the outer wall side of the side plate 43 (44). A rotation blocking member 60 is prepared as shown in FIG. 16. The rotation blocking member 60 is constructed by: a main body 60A which is inserted into the adjusting hole 50; a projecting portion 60B which is integratedly formed in a rear edge of the main body 60A; a plurality of engaging projections 60C formed on a peripheral surface of a front edge side of the main body 60A; and a rotation blocking projection 60D formed in a small-diameter portion at the front edge of the main body 60A. An inserting groove 50B adapted to guide the engaging projections 60C so as to be inserted into the groove 50B is formed on the adjusting hole 50.

When the rotation blocking member 60 is inserted into the adjusting hole 50, the projecting portion 60B is come into engagement with the key-shaped hole 50A and each engaging projection 60C is inserted into the inserting groove 50B, so that its rotation is blocked. Since the projection 60D is retained to the sector gear 49 of the eccentric cam 47, the subsequent rotation of the eccentric cam 47 can be prevented.

Figure 18:
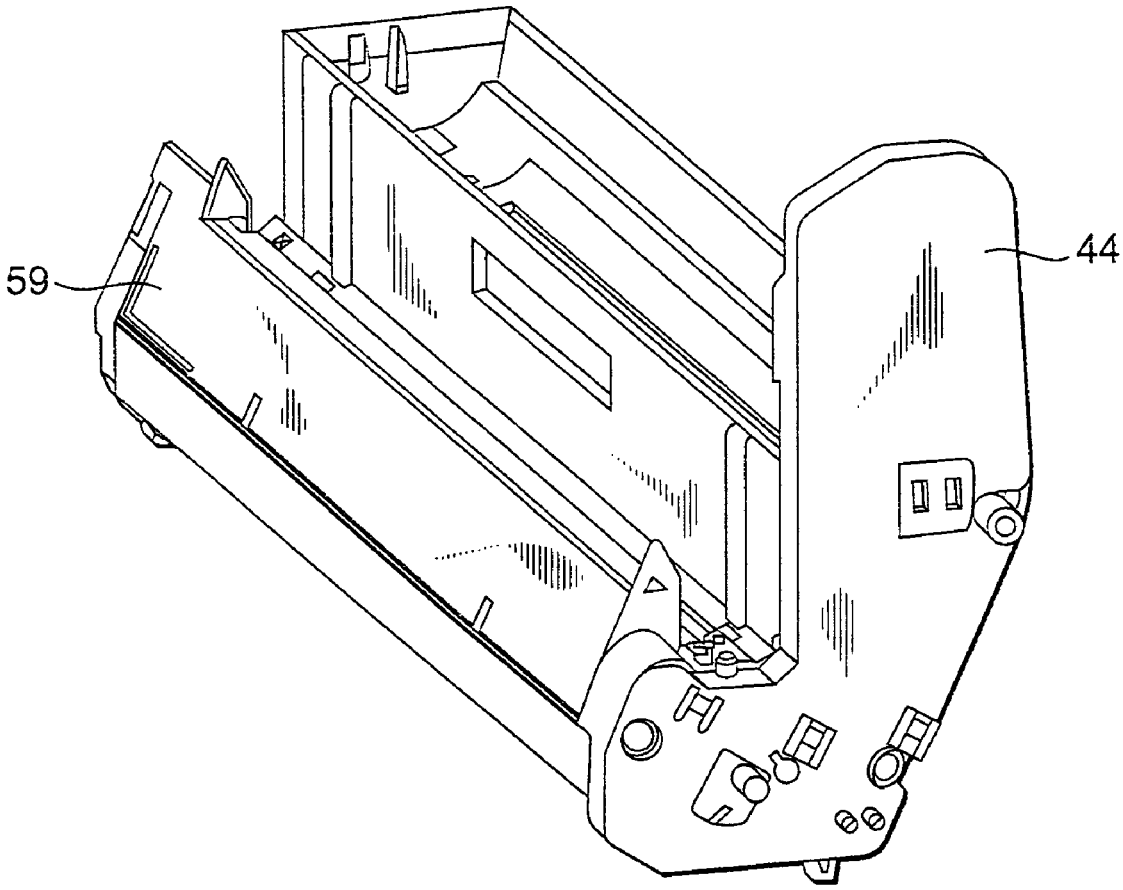
FIG. 18 is a perspective view showing the completed state after the end of measurement of the cartridge.

Finally, as shown in FIG. 18, an upper cover 59 is attached to the side plates 43 and 44 so as to cover the photosensitive drum and the like, thereby completing the image drum cartridge 40.

A rotational speed of the photosensitive drum 41 and that of the developing roller 42 slightly differ. The peripheral velocity of the developing roller 42 is set to a value of about 1.2 to 1.3 times as high as that of the photosensitive drum 41. Even if the peripheral velocities differ as mentioned above, since the difference between them is small, the predetermined tractive force is applied to the film 31 and no problem occurs upon measurement.

Figure 19:
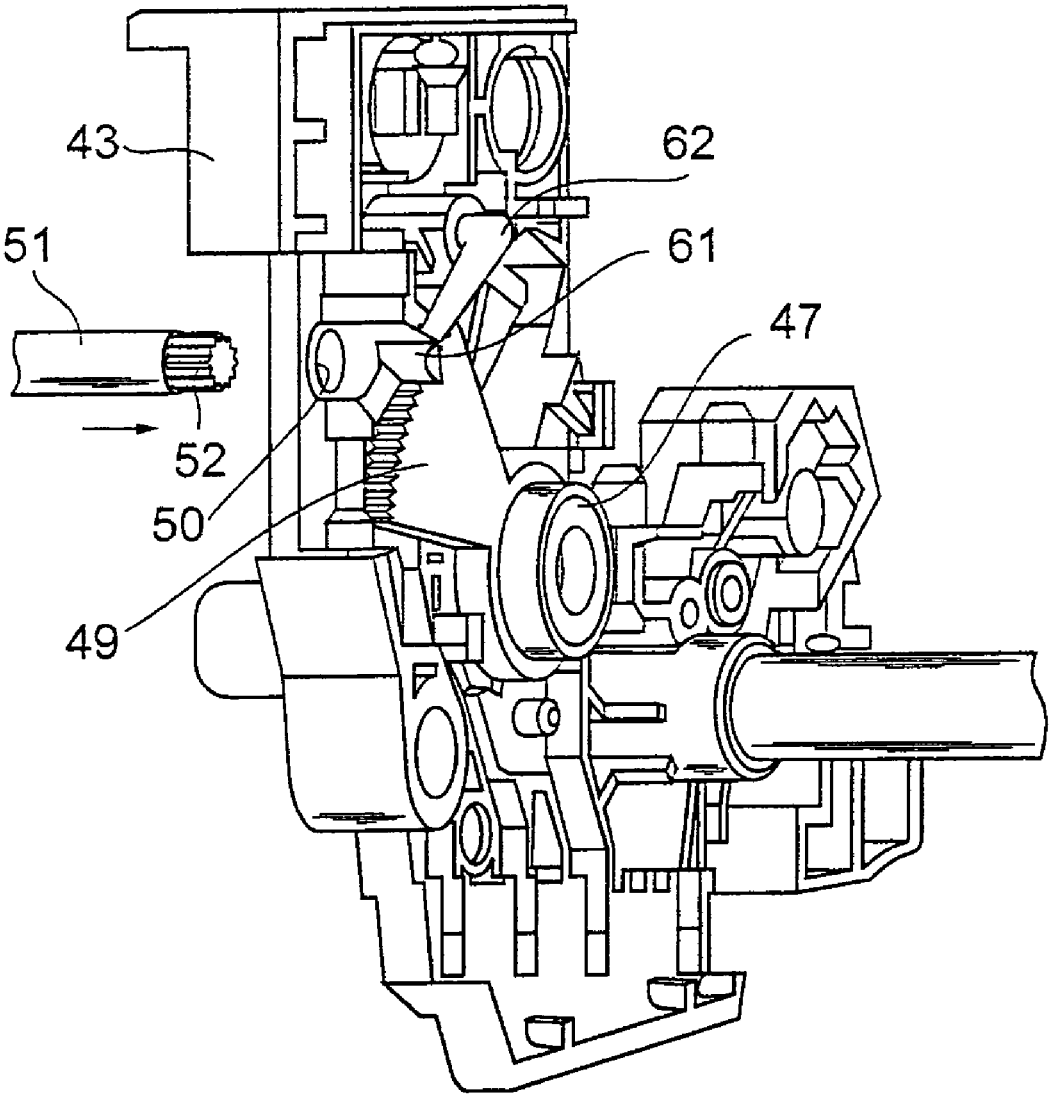
FIG. 19 is a perspective view when seen from the inside of a side plate according to a modification of the fifth embodiment.
Figure 20:
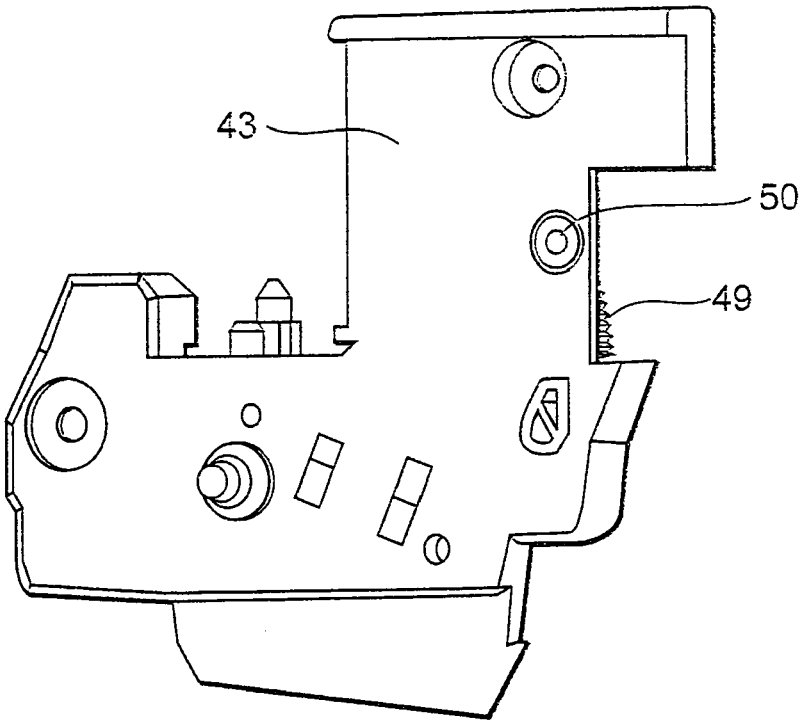
FIG. 20 is a perspective view when seen from the outside of the side plate according to the modification.
Figure 21:
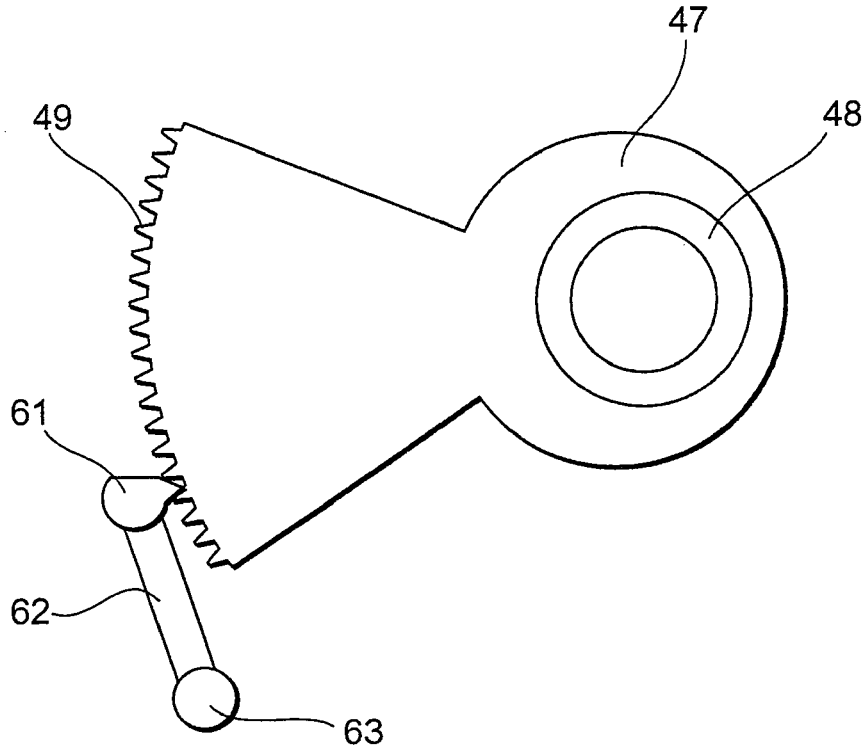
FIG. 21 is a constructional diagram of a main section according to the modification.

FIGS. 19 to 21 are diagrams showing modifications of the fifth embodiment. In this modification, a locking portion 61 is retained to the sector gear 49 of the eccentric cam 47, thereby blocking the rotation of the eccentric cam 47 and positioning it. The locking portion 61 is integratedly formed at a front edge of an arm 62. A base portion 63 of the arm 62 is inserted in an inserting hole of a cylinder portion provided for the side plate 43 (44). The locking portion 61 and the arm 62 are integratedly made of a synthetic resin such as polyacetal or the like and can be elastically deformed. The locking portion 61 is retained to the sector gear 49 at a position where it faces the adjusting hole 50 of the side plate.

In the modification, the adjusting tool 51 is inserted into the adjusting hole 50, the locking portion 61 is pressed at the edge surface of the pinion gear 52, and the arm 62 is bent, thereby unlocking the locking portion 61 from the sector gear 49. As mentioned above, by rotating the adjusting tool 51, the eccentric cam 47 is rotated through the sector gear 49. If the eccentric cam 47 is rotated by a predetermined amount (until the tractive force of the film 31 is equal to 200 gf), the adjusting tool 51 is pulled out of the adjusting hole 50. In this case, since the arm 62 is returned to the original rectilinear shape by the elastic force, the locking portion 61 is automatically retained to the sector gear 49 and blocks the rotation of the eccentric cam 47.

Figure 22:
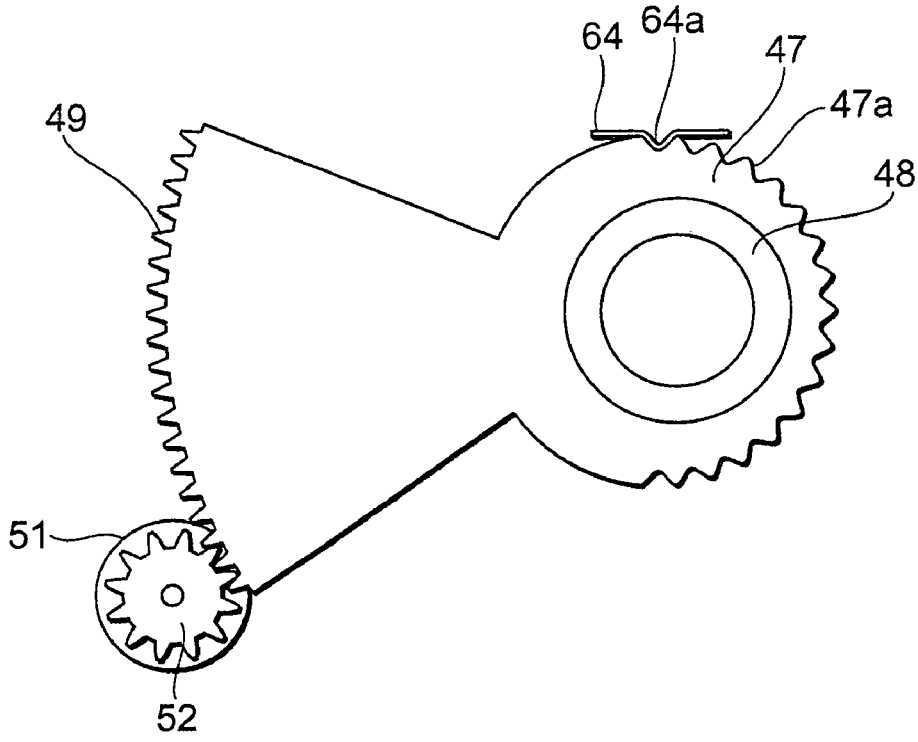
FIG. 22 is a constructional diagram of a main section according to another modification of the fifth embodiment.

Another modification of the fifth embodiment is shown in FIG. 22. In this modification, a plurality of concave portions 47*a* corresponding to the number of teeth and a pitch of the sector gear 49 are formed on the peripheral surface of the eccentric cam 47. A leaf spring member 64 in which a center projecting portion 64*a* is retained to the concave portion 47*a* is arranged in an upper position of the spindle hole 46 of the side plate.

In this modification, by inserting the adjusting tool 51 into the adjusting hole 50 and rotating the adjusting tool 51 while removing the projecting portion 64*a* from the concave portion 47*a* against the elastic force of the leaf spring member 64, the eccentric cam 47 can be rotated by the predetermined amount (until the tractive force of the film 31 is equal to 200 gf). At a point of time when the adjusting tool 51 is pulled out, the projecting portion 64*a* is inserted into the concave portion 47*a* under this position by the elastic force of the leaf spring member 64, so that the rotation of the eccentric cam 47 can be blocked.

In the modification, when the projecting portion 64*a* of the leaf spring member 64 is removed from the concave portion 47*a*, a click feeling or a removing sound occurs. Therefore, the operator can execute the operation while recognizing the progress of the adjusting operation.

Figure 23:
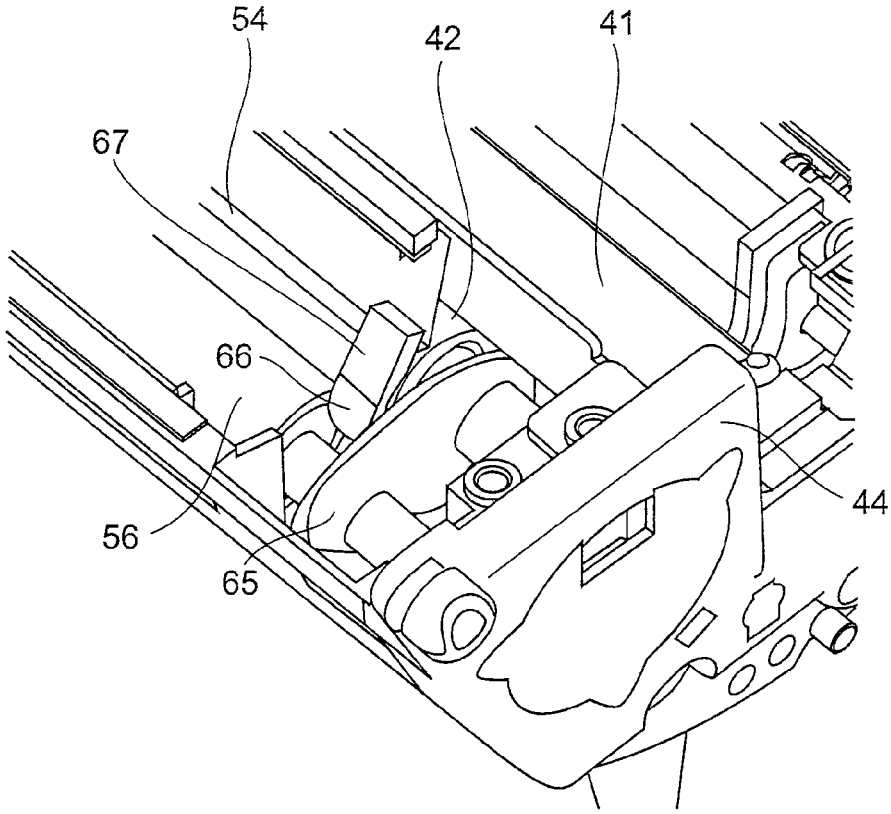
FIG. 23 is a perspective view of a main section of an image drum cartridge according to an application example of the fifth embodiment.
Figure 24:
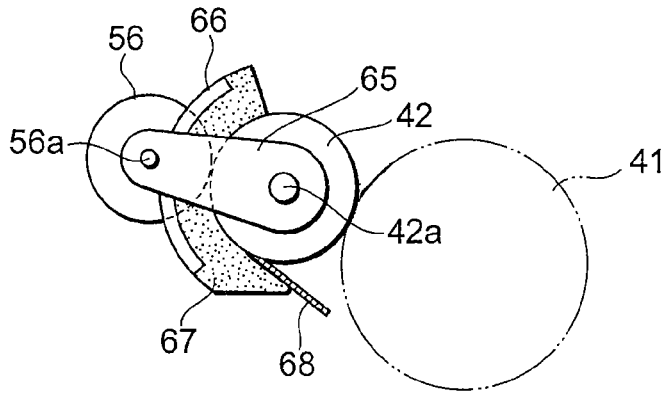
FIG. 24 is a front view of the main section of the application example.

FIGS. 23 and 24 show an application example to the fifth embodiment. In those diagrams, a length of supplying roller 56 is set to be smaller than the developing roller 42. An axis 42*a* of the developing roller 42 and an axis 56*a* of the supplying roller 56 are integratedly coupled by a link member 65. An edge surface of an arc-shaped attaching plate 66 is fixedly bonded to the inner surface of the link member 65. A sealing member 67 made of an elastic member such as a felt or the like is attached to the attaching plate 66. The sealing member 67 has been pressed to the peripheral surface of the edge portion of the developing roller 42 in close vicinity thereto, thereby preventing a leakage and drop-out of the toner. A sheet film 68 which is in pressure contact with the whole length of the developing roller 42 is arranged in a position under the developing roller 42. The sheet film 68 is also provided to prevent the leakage of the toner. As shown in FIG. 23, the developing blade 54 is arranged over the developing roller 42.

In this application example, the supplying roller 56, the sealing member 67, and the like are integrated with the developing roller 42 through the link member 65. Therefore, even if the axial position of the developing roller 42 is fluctuated by being decentered by the eccentric cam 47 on the basis of the measured tractive force of the film 31, since the supplying roller 56 and the like are integratedly fluctuated, there is no need to re-adjust the supplying roller and the sealing member 67.

What is claimed is:

1. A contact pressure setting method of setting a contact pressure between a photosensitive body and a developing roller of an image forming apparatus, comprising the steps of:

inserting a polyethylene film between the photosensitive body and the developing roller, the film having a thickness generally equal to 0.03 mm and a width generally equal to 5 mm; and setting said contact pressure so that a pulling force to pull out said film is equal to or larger than 30 gf.

2. The contact pressure setting method according to claim 1, wherein the pulling force is set to a value within a range from 30 to 250 gf.

3. A contact pressure setting method of setting a contact pressure between a photosensitive body and a developing roller of an image forming apparatus, comprising the steps of:

inserting a polyethylene film between the photosensitive body and the developing roller, the film has a thickness generally equal to 0.03 mm and a width generally equal to 5 mm; and setting said contact pressure so that a frictional force between said film and the photosensitive body and the developing roller is equal to or larger than 30 gf.

4. The contact pressure setting method according to claim 3, wherein the frictional force is set to a value within a range from 30 to 250 gf.

5. An image forming apparatus for developing an electrostatic latent image on a photosensitive body by allowing said photosensitive body to be come into contact with a developing roller, wherein a contact pressure between said photosensitive body and said developing roller is set in such a manner that, when a strip-shaped polyethylene film whose thickness is equal to 0.03 mm and whose width is equal to 5 mm is inserted into between said photosensitive body and said developing roller, a frictional force between said polyethylene film and both of said photosensitive body and said developing roller is equal to or larger than 30 gf.

6. The image forming apparatus according to claim 5, wherein said frictional force in an edge portion in an axial direction of each of said photosensitive body and said developing roller is equal to or less than two times of said frictional force in a center portion in an axial direction.

7. The image forming apparatus according to claim 5, wherein by making pressing forces in both edge portions in an axial direction for pressing said photosensitive body and said developing roller different, said frictional forces in both of the edge portions in an axial direction are set to be almost equal.

8. The image forming apparatus according to claim 5, wherein said frictional force is set to a value within a range from 30 to 250 gf.

9. The image forming apparatus according to claim 5, comprising:

a position adjusting section to adjust position of said developing roller with respect to said photosensitive body in order to set said contact pressure.

10. The image forming apparatus according to claim 5, wherein said position adjusting section has a decentering and supporting portion to decenter and support axis of said developing roller, and rotates said decentering and supporting portion in order to adjust position of said developing roller with respect to said photosensitive body.

11. The image forming apparatus according to claim 10, wherein said position adjusting section further has a fixing portion to fix said decentering and supporting portion after adjustment of said position of said developing roller.

12. The image forming apparatus according to claim 9, further comprising:

a supplying roller which contacts with said developing roller and is used to supply developer to said developing roller, wherein said supplying roller is coupled with said developing roller so that position of said supplying roller simultaneously changes together with that of said developing roller.

* * * * *